United States Patent [19]

House et al.

[11] 4,358,088

[45] Nov. 9, 1982

[54] WINCH DRIVE AND BRAKING MECHANISM

[75] Inventors: Lawrence A. House, Maple Ridge; Vladimir Kumpa, North Vancouver; John E. Magnuson, Surrey, all of Canada

[73] Assignee: PACCAR of Canada Ltd., Quebec, Canada

[21] Appl. No.: 196,462

[22] Filed: Oct. 14, 1980

[51] Int. Cl.[3] ..... B66D 1/14

[52] U.S. Cl. ..... 254/349; 192/12 B; 192/12 C; 254/323; 254/376; 379

[58] Field of Search ..... 254/323, 350, 349, 348, 254/347, 376, 379; 192/14, 12 B, 16, 12 C, 18 A

[56] References Cited

U.S. PATENT DOCUMENTS

| | | | |
|---|---|---|---|
| 3,853,303 | 12/1974 | Wineburger | 254/347 |
| 4,076,219 | 2/1978 | Behrends et al. | 254/349 |
| 4,078,770 | 3/1978 | Yates et al. | 254/347 |
| 4,088,305 | 5/1978 | Wineburner et al. | 254/349 |
| 4,090,693 | 5/1978 | Hoehn et al. | 254/347 |
| 4,187,936 | 2/1980 | Davenport | 254/350 |

*Primary Examiner*—Billy S. Taylor

*Attorney, Agent, or Firm*—Seed, Berry, Vernon & Baynham

[57] ABSTRACT

A drive train for a winch from a continuously rotating input source to an intermittently rotated drum in which the drive train is through a clutch, then to a shaft, then through a continuously driven internal brake which forms a part of the drive train from the shaft, then to the drive train to the drum, with the shaft being provided with a one-way clutch so that the brake automatically is engaged for lowering the load by reversing the drum. A free-spool circuit is provided which can be operated only in the brake release position for safety and is operated off the brake release hydraulic control fluid pressure. A static or manual pump control fluid circuit is provided for operating the clutch, brake and/or free spool. A combination driving clutch and drag clutch are energized by opposite directional movement of a single piston for coupling an input to an output or stopping movement of the output.

11 Claims, 5 Drawing Figures

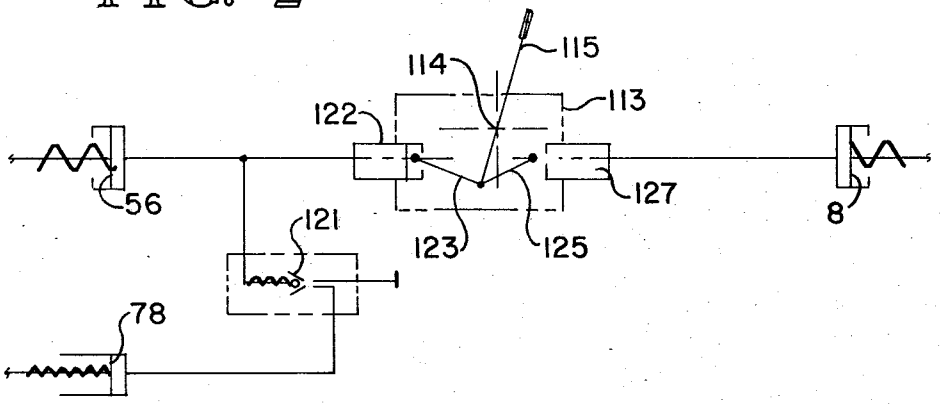
FIG. 2
FIG. 2A
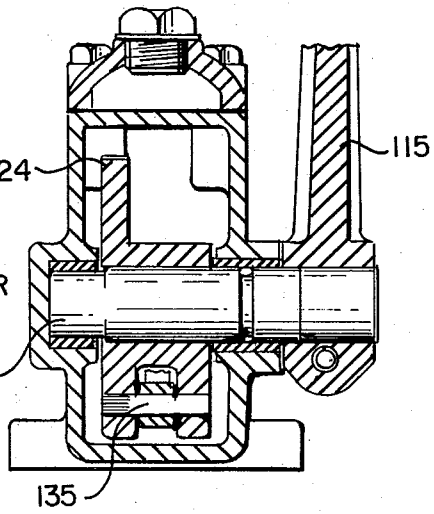
FIG. 4
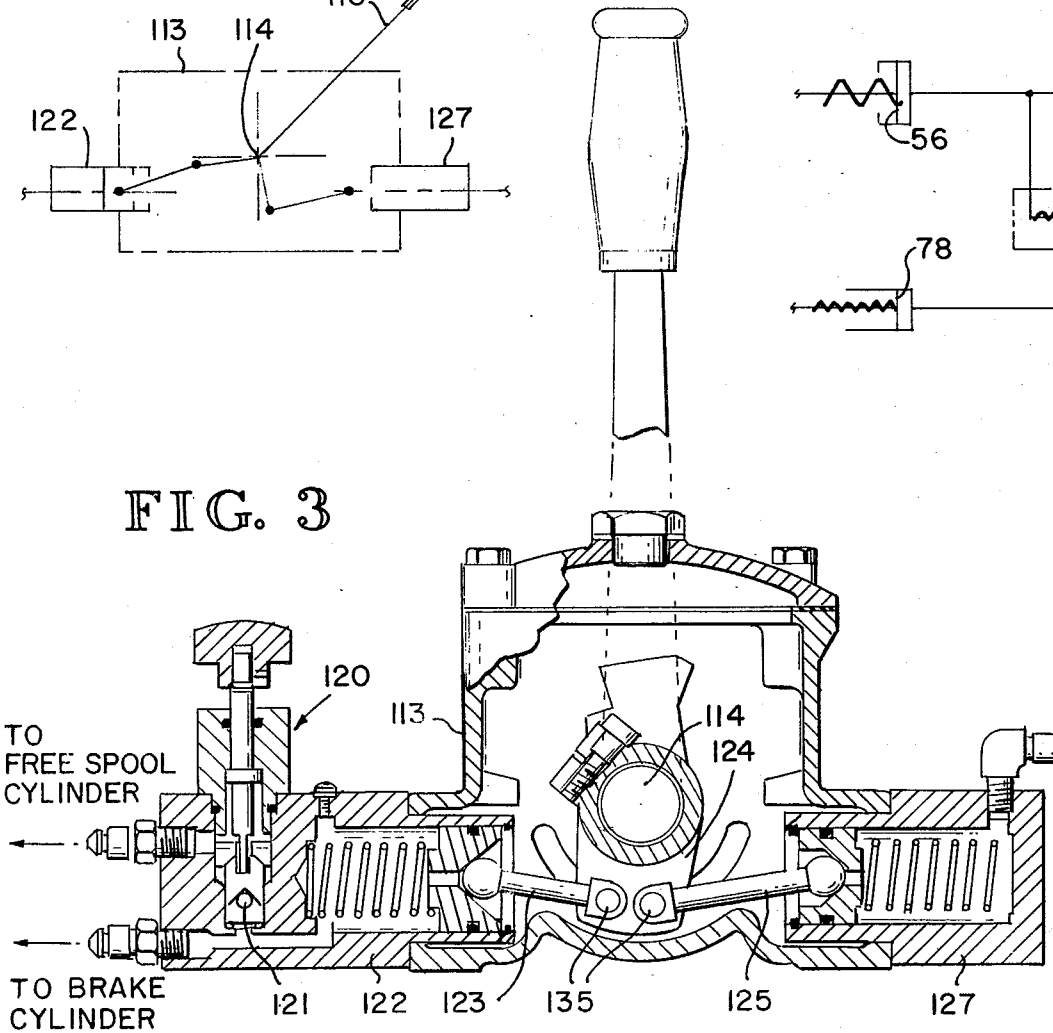
FIG. 3

WINCH DRIVE AND BRAKING MECHANISM

BACKGROUND OF THE INVENTION

1. Field of the Invention

This invention pertains to winch drive and braking mechanisms and, more particularly, to improvements in a total winch drive and brake system, as well as the improvements in components thereof.

2. Description of the Prior Art

Conventional winches require the brake and clutch to by synchronized by controls to prevent the load from dropping. This requires added expense in manufacturing and maintenance and can cause an accidental dropping of the load if this synchronization is not maintained.

In vehicular-mounted winches for use in log skidding and the like, the workmen must be able to pull the cable from the winch drum to reach remote locations from the winch. A problem has always been how to first eliminate the inherent friction and hydraulic oil drag in a winch drive to allow free pulling of the cable and to be sure that the winch controls are always prevented from accidentally putting the winch prematurely into a free-spool condition. On the other hand, it is desirable to provide some drag on the drum when intentionally dropping a load to prevent overrunning of the drum or snarling of the tightly wound cable on the drum.

Winch drive controls to provide a safe free-spool operation are expensive and have utilized continuously flowing fluid, generally a very low-pressure fluid from a separate pump or from a diverted portion of the power fluid for the winch.

A common problem in oil-immersed driving elements is that the viscous oil movement causes the output of the drive to creep or move. Various drag brakes have been utilized to prevent such movement.

SUMMARY OF THE INVENTION

This invention pertains to improvements in each of the above areas as well as to the unique combination of these improvements into a unitary, safe, relatively inexpensive, vehicular-mounted winch.

Thus it is an object of this invention to provide a winch drive and braking mechanism which at all times automatically employs the brake after the load is hoisted or pulled, but maintains a slight drag on the drum when intentionally dropping a load.

It is another object of this invention to use an operating brake as part of the primary drive train so that driving occurs through the brake and thus is automatically engaged when the driving ceases, and which is positioned to allow drag on the drum when rapidly lowering a load.

It is a still further object of this feature of the invention to provide an inexpensive and safe winch drive mechanism and brake.

Basically, these objects are obtained by placing a disk brake on a rotating shaft as part of the drive train to the winch drum. This shaft is then rotated by a clutch in one rotational direction for hoisting or pulling, but is engaged in a locked position by a separate overrunning or one-way clutch in the opposite rotational direction so that the load in that opposite rotational direction can only be moved by then releasing the disc brake drive component on the shaft. The brake is placed at an intermediate stage of the gear train remote from the drum. The advantage of this system is that it is simple in construction and failproof in that the brake must always be engaged whenever the driven shaft tries to rotate in the opposite or lowering direction, but there is no need for complicated synchronization of controls to energize the brake when the clutch is de-energized since, in this invention, the brake is at all times a part of the drive train and cannot be avoided regardless of the condition of clutch operation. Thus, except for a failure in the brake itself, the brake cannot be inadvertently left off with a load on the drum. Furthermore, when the brake is intentionally released to drop a load, as is a frequent occurrence in logging winches, the downstream drive train imposes sufficient drag on the drum to prevent the tightly wound cable from snarling.

It is an object of a second feature of this invention to operate the free spool in a manner in which it cannot be inadvertently energized and which freely releases the drum for ease of turning.

It is still another object of this feature of the invention to provide a free-spool control only in the brake release condition.

Basically, these objects are obtained by locating the free-spool decoupler at a final stage in the gear train and by energizing the free spool only from the fluid pressure which energizes a release of the brake. Preferably, the free-spool pressure can be obtained only when the brake is not only released but when it is fully released. The free spool can be re-engaged, that is, free spooling ended automatically when the manual hand control is returned to a neutral setting.

As is apparent, the advantages are that the free spool cannot be inadvertently energized except in a condition where the brake is released or fully released so that free spooling can occur only when the operator has taken some action which indicates that he is willing to fully release the brake to lower the load. Secondly, since the free spool becomes re-engaged upon manual return of the control to neutral, the free spool cannot be inadvertently left in the free-spooling condition during subsequent operation of the winch. Finally, since the free spool is at a final drive gear, the drum is free to rotate for ease of manually pulling off the cable.

It is another object of this invention to provide a static brake, clutch and free-spool control utilizing a static fluid link.

These objects are best obtained by providing a manual hand control which operatively engages either of two separate brake and clutch cylinders to deliver a static, desired amount of fluid to operate a clutch drive or brake release and to activate the free spool utilizing the pressure only from a full brake-release condition to decouple the drum for free spooling only when in a brake-release condition.

A disc clutch is employed to couple and uncouple the input from the output of the drive train. When uncoupling occurs, it is another feature of this invention that in the same motion, simultaneous drag is imposed on the output to prevent movement of the output from viscous oil movement.

These above features are also combined into this unitary winch in a very effective manner for simplicity of manufacture and control of a heavy-duty, vehicular-mounted winch. Thus the winch is safe to operate, easy to maintain in field conditions, and provides advantageously all of the necessary functions needed in a vehicular-mounted winch for log skidding and the like.

BRIEF DESCRIPTION OF THE FIGURES OF THE DRAWING

FIGS. 2 and 2A are operational views of a schematic control circuit for operating the winch of FIG. 1 and employing the principles of the invention.

FIG. 3 is a sectional view illustrating the details of part of the control shown in FIG. 2.

FIG. 4 is a sectional view taken through the operating handle of FIG. 3.

DETAILED DESCRIPTION OF THE PREFERRED EMBODIMENTS

Figure 1:
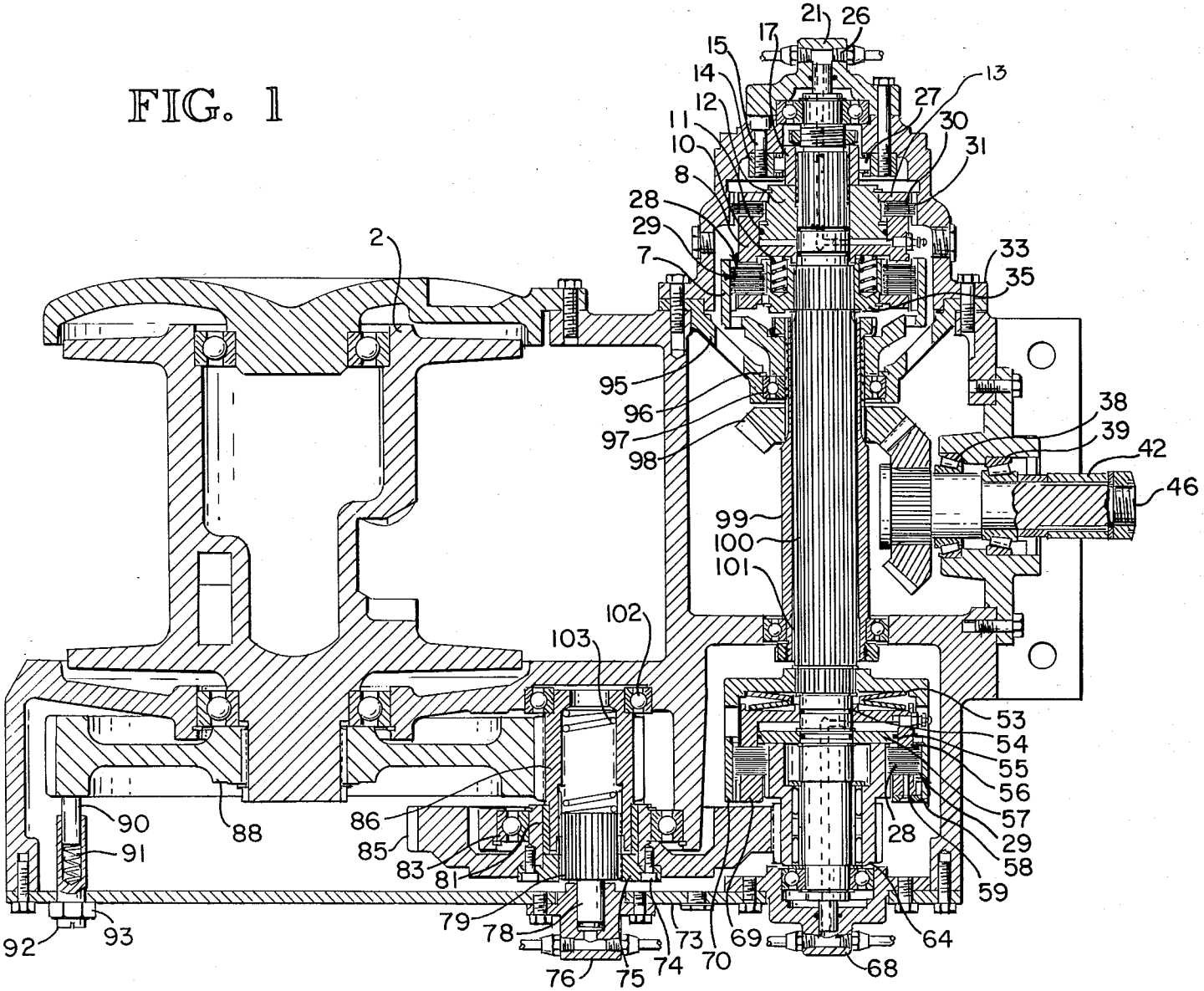
FIG. 1 illustrates a sectional view of a winch employing the principles of the invention.

The winch of this invention is preferably for use on small rubber-tired skidders up to 100 hp, but the principles are equally applicable to other winches. The input drive to the winch can be provided by a direct-driven P.T.O. of the vehicle or a converter-driven P.T.O. A low-pressure hydraulic system provides control for the three winch functions: clutch engagement for hauling in, brake release for lowering a load, and free-spool declutch for manual pay-out of the cable. When the control lever is in the neutral position, the clutch is disengaged, the brake is spring applied, and the free-spool disengage gear is in the engaged position.

The input drive to the winch is normally supplied by a universal drive shaft which the customer connects to the input shaft 46. Sleeve 42 is for shipping purposes only and is replaced by the customer's universal joint when he connects the drive line. The input shaft 46 is mounted on preloaded Timken bearings 38 and 39. The input shaft 46 drives a bevel gear set 98. The driven bevel gear 98 is splined to a spline tube 99 which is supported by two ball bearings 97. The spline tube is connected to a drive cup 7 which drives a set of steel divider clutch plates or discs 29 which are splined to the drive cup.

When the vehicle engine is running and the winch control is in neutral, the constant running P.T.O. drives the bevel gear set, the drive cup, and the steel divider plates. These are the only rotating parts in the winch when the winch control is in neutral. This represents more than 90% of the time that the vehicle is in operation. However, it should be noted that, with some disadvantages, the clutch can be in the vehicle, thus upstream of the P.T.O., if desired.

In order to engage the clutch, hydraulic pressure is supplied through cap 21 and a hole in the center of the main shaft 100. This forces the clutch piston 8 into engagement with the clutch plates 28 and 29. The input drive is then transmitted from the drive cup 7 to the clutch hub 35, which is splined to the main shaft 100. The main shaft 100 is connected to the drive gear 64 by a brake assembly consisting of 53–59, 69–70. The drive is then transmitted from the drive gear 64 through the first reduction gear 85, pinion gear 86, and bull gear 88, which is spline-connected to the cable drum 2.

When the clutch piston 8 is not pressurized, springs 10 hold the clutch in the disengaged mode. Since the clutch plates 28 and 29 rotate in a housing partly filled with oil, there is a viscous drag that tends to drive the main shaft 100. To prevent this from happening, a clutch drag brake consisting of items 11, 12, 13, 30 and 31 is provided. This brake connects the drive shaft 100 to the clutch housing 33 through clutch plates 30 and 31. This clutch brake is held engaged by the clutch release springs 10, which provide sufficient brake capacity to prevent the main shaft 100 from rotating when the main clutch is disengaged.

The clutch piston 8 provides a dual function. When energized by pressure oil, it engages the main clutch. When the oil pressure is removed, the release springs 10 uniquely move the piston 8 into engagement with the clutch brake.

A one-way clutch assembly is installed to connect the main shaft 100 with the clutch housing 33. This assembly consists of the sprag hub 17, sprag clutch 27, and sprag housing 14. The sprag housing 14 is fastened to the clutch housing 33 by cap screws 15. This one-way clutch assembly allows free rotation of the main shaft 100 in the "winch-in" or hoist direction and locks up to prevent the main shaft 100 from rotating in the opposite direction. When the main clutch is disengaged and the cable load tries to rotate the main shaft in the "pay-out" or lowering direction, the one-way clutch locks up and the load is held stationary until the brake is released.

The winch brake is mounted on the main shaft 100 and connects the drive gear 64 to the main shaft. It is spring applied by Belleville springs 53 which force the piston 56 to engage a series of friction plates 28 and divider plates 29. The divider plates 29 are spline-connected to the brake ring 70, which in turn is splined to the main shaft 100. The friction plates are spline-connected to the drive gear 64. The brake is released by supplying pressurized oil through seal cap 68 and the hole in the center of the main shaft 100 to the brake piston 56.

As described above, the brake is an integral part of the drive train and transmits torque between the main shaft 100 and the drive gear 64 while hauling in a load.

When the operator pulls cable from the drum to attach it to a log, he must do so with a minimum amount of effort. Since the brake described above is running in a housing partly filled with oil, the viscous drag between the friction plates 28 and drive plates 29 causes a resistance to rotation of the drive gear 64. This, in combination with frictional resistance in the gear train, would require too much effort to manually pull the cable from the drum. In order to avoid this condition, a free-spool assembly is installed between the first reduction gear 85 and the pinion gear 86.

It should also be noted, however, that this location of the brake away from the drum or final gear stages advantageously uses the inherent viscous drag to keep the cable from snarling. That is, the cable when tightly wound on the drum is similar to a clock spring; and if the drum is rapidly rotated and then the load released, as in dropping a load, the cable will continue to try and unwrap. The drag downstream of the brake will slow the drum and minimize the cable release.

The free-spool assembly consists of a simple splined sliding coupling, referred to as the disengage gear 79, which is carried on an internal spline cut in the pinion gear 86. When the free-spool assembly is in the engaged position or lower position in FIG. 1, the disengage gear 79 is also connected to an internal spline of the free-spool coupling 75. The free-spool coupling 75 is connected to the first reduction gear 85 by cap screws 74. When the free-spool assembly is in the engaged position, the drive from the first reduction gear 85 is transmitted through the disengage gear 79 to the pinion gear 86. The disengage gear 79 is urged into engagement by spring 103. In the engaged position, the disengage gear 79 is held in contact with piston 78 by the spring 103.

To achieve a free-spool condition, pressure oil is supplied through seal cap 76 and acts on the end of piston 78, which in turn moves the disengage gear upward in FIG. 1 out of engagement with the free-spool coupling 75. This allows the cable drum 2, bull gear 88, and pinion gear 86 to be disconnected from the brake and reduces the resistance to rotation of these items. This allows the operator to pull cable from the drum with a minimum of effort.

When the disengage gear 79 is in the engaged position, the first reduction gear 85 and pinion gear 86 rotates as one unit on ball bearings 83 and 102. When the disengage gear 79 is in the disengage position, the pinion gear 86 rotates by itself in sleeve bearing 81 and ball bearing 102.

Some operators like to have the cable drum rotate as free as possible so that little effort is required when manually pulling on the cable. Other operators like to have some resistance to drum rotation so that the cable does not run off too freely. In order to provide a varying resistance to free spool, a free-spool drag assembly consisting of items 90–93 is provided. This consists of a drag plug 90 which is forced into contact with the bull gear 88 by the spring 91. The adjusting screw is threaded into the cover plate 73 and locked by lock nut 93. This provides an adjustable spring load, resulting in an adjustable free-spool drag that can be adjusted to suit each operator's requirements.

When the winch controls are in the neutral position, there is no hydraulic pressure on the clutch, brake, or free-spool pistons, and the only rotating parts are those up to the divider plates 29.

When pressure is applied to engage the clutch, the main shaft 100 drives the drive gear 64 through the spring-applied brake assembly. The free-spool disengage gear 79 is in the engaged position and the drive gear 64 drives the first reduction gear 85, which in turn drives the pinion gear 86 and bull gear 88 which drives the cable drum in the "winch-in" direction.

As soon as pressure oil is removed from the clutch, the clutch disengages the input drive from the main shaft 100. The cable load then tries to drive the cable drum and gearing in the opposite direction, but the main shaft is prevented from rotating in that direction by the sprag clutch 26. The load is then held by the brake assembly and the sprag clutch. This feature allows the brake to be engaged during the winching operation, and the sprag clutch prevents any drop-back of the load when the clutch is disengaged. This eliminates the need for synchronizing brake engagement with clutch disengagement, as is the case on some conventional designs.

In this arrangement, the main shaft 100 is stationary at all times, except when hauling in. The brake is engaged at all times, except when lowering a load.

When a load has been raised by the winch, it can be lowered gradually on the brake by regulating the pressure acting on the piston 56. Alternatively, the load can be dropped suddenly by fully releasing the brake.

Once the load is on the ground, the free-spool disengage gear 79 can be moved into the disengage position by supplying pressure oil to the piston 78.

The free-spool disengage gear 79 can be allowed to re-engage while the pinion gear 86 is rotating. Although engagement does not actually take place until the pinion gear 86 has stopped rotating, the ends of the splined teeth on the disengage gear 79 rub against the ends of the splined teeth in the free-spool coupling 75. The ends of the splined teeth in both parts have a radiused profile and are hardened by carburizing. This prevents these parts from being damaged when hydraulic pressure is removed from the end of piston 78 while the pinion gear 86 is rotating.

FIGS. 2 and 2A are schematic drawings showing the master control connected to the brake, clutch, and free-spool cylinders of the winch. FIGS. 3 and 4 are of the master control that has the free-spool selector valve incorporated in the brake cylinder. The master control assembly can be described as a hand pump that displaces hydraulic fluid from two independent cylinder assemblies: one to supply oil for actuating the clutch and the other for supplying pressure oil to release the brake and free-spool assembly in the winch. Clutch cylinder assembly 127 supplies oil to the clutch, and brake cylinder assembly 122 supplies oil to the brake and free spool.

The master control housing 113 is filled with hydraulic oil and provides a reservoir for the clutch and brake cylinder assemblies 127 and 122. The handle 115 is attached to the shaft 114 by a spline connection. A rocker plate 124 is attached to the shaft 114. Brake push rod or link 123 and clutch push rod or link 125 are attached to the rocker plate and pivot independently on push rod pins 135. The clutch push rod and brake push rod each have a spherical ball formed on one end. In each case, this ball contacts a tapered bore in the piston of each cylinder assembly. This ball and tapered seat form a valve that traps oil in the cylinder when the piston is moved by the push rod, to displace oil from the cylinder.

When the handle is moved to the left, push rod 125 moves the piston in its cylinder to the right. At the same time, push rod 123 disengages from its piston, allowing oil from the reservoir to fill the brake cylinder assembly. When the handle 115 is moved to the right, push rod 123 displaces oil from the brake cylinder and push rod 125 loses contact with its piston, allowing oil from the reservoir to fill the clutch assembly.

FIG. 2 illustrates the master control assembly connected with hydraulic lines to the clutch cylinder, brake cylinder, and free-spool cylinder in the winch. As described above, when the master control handle 115 is moved to the left, hydraulic oil is displaced from the clutch cylinder assembly 127 on the master control and is used to engage the clutch in the winch.

When the master control handle is moved to the right, oil is displaced from the brake cylinder assembly and supplied to the brake cylinder in the winch.

When the master control handle is moved to the right into its extreme travel position, the push rod pin 135 that supports the brake push rod 123 moves into an over-center position (FIG. 2A) between the shaft 114 center and the center of the spherical ball at the end of the brake push rod 123. Because pressure oil continues to act on the brake cylinder piston with the handle in the over-center position, the handle is locked in this position and the winch brake is in the full release position.

The free-spool selector valve 120 illustrated in FIG. 3 is a check valve 121 that can be manually opened by depressing the knob on the end of the valve stem. To actuate the free spool, the operator moves the master control handle in the brake release direction to the over-center position. This releases the brake, allowing the load to drop, and the brake release cylinder absorbs all the oil that is displaced by the master control brake cylinder assembly. When the operator depresses the free-spool selector valve, he opens the check valve, allowing oil from the winch brake cylinder to flow to the free-spool cylinder, moving the free-spool disengage gear into the disengaged position. To re-engage the free spool and winch brake, the master control handle is returned to the neutral position and oil flows freely out of the free-spool cylinder and winch brake cylinder back into the master control. There is no need for the operator to depress the free-spool selector valve since the check valve allows free flow from the free-spool cylinder to the master control as soon as the master control handle is returned to neutral. While the preferred embodiment has been illustrated and described, it should be understood that variations of the invention will be apparent to one skilled in the art without departing from the principles herein. Accordingly, the invention is not to be limited to the specific embodiment illustrated in the drawing.

I claim:

1. A winch having a drum, means for driving the drum, said drive means having a controllable clutch and a brake, the improvement comprising:

a drive train connecting a power supply to the drum, said drive train including a rotatable drive shaft, a controllable clutch on one end of said drive shaft for selectively rotating said drive shaft in a hoist direction, an automatic one-way clutch on said drive shaft for allowing rotation of said drive shaft in said hoist direction but locking the drive shaft against movement in the opposite lowering direction, a controllable brake on said rotatable drive shaft coupling the drive shaft to the drive train downstream of the drive shaft and wherein said brake is an integral driving part of the drive train during hoisting of a load, and control means for selectively, alternately (1) actuating the controllable clutch to rotate the drive shaft for hoisting a load using the brake or (2) releasing the brake for releasably allowing restricted movement of the drive train downstream of the drive shaft relative to the drive shaft with the drive shaft locked by the one-way clutch for lowering a load.

2. The winch of claim 1, including a free-spool device for decoupling the drive train downstream of the brake.

3. The winch of claim 1, including drag means for holding the shaft against rotation in the hoist direction when the clutch is disengaged.

4. The winch of claim 2, said winch including a housing, said automatic clutch operable to lock said drive shaft to said housing in said drum-lowering direction, said controllable clutch including an outer splined cup, an input drive gear continuously driving said outer cup, an inner splined ring drivingly meshing with said drive shaft, clutch discs drivingly coupling said outer cup and inner ring when said discs are axially compressed, and a clutch piston for compressing said discs.

5. The winch of claim 4, including drag means for holding the rotatable drive shaft against rotation in the hoist direction when the clutch is disengaged, said clutch piston movable axially and operable to release said discs and simultaneously engage said drag means.

6. The winch of claim 1, said brake including a splined outer brake ring, an inner splined drive gear, splined brake discs drivingly coupling the drive gear and brake ring when axially compressed, spring means normally axially compressing said brake discs, and piston means axially movable to overcome said spring means and release said brake discs.

7. The winch of claim 2, said free-spool device including a free-spool coupling gear, a downstream pinion gear axially aligned with and adjacent to said coupling gear, an axially movable disengage gear meshing with said coupling gear and pinion gear in a driving position and movable axially to disengage one of said coupling or pinion gears to uncouple the coupling and pinion gears, spring means for axially moving the disengage gear into one position and piston means for moving the disengage gear in the opposite direction.

8. The winch of claim 2, including drag means on said drive train downstream of said free-spool device for providing an adjustable resistance to rotation of the drum during free spool.

9. The winch of claim 4, said brake including a splined outer brake ring, an inner splined drive gear, splined brake discs drivingly coupling the drive gear and brake ring when axially compressed, spring means normally axially compressing said brake discs, and piston means axially movable to overcome said spring means and release said brake discs.

10. A winch having a drum, power means for driving said drum, a clutch, brake and free-spool release, and control means for remotely operating said clutch, brake and free-spool release at an operator's station, comprising:

a drive train connecting a power supply to the drum, a remotely controlled clutch for disconnecting the power supply, said drive train including an automatic one-way clutch for allowing rotation of the drive train in a hoist direction but locking the drive train against rotation in the reverse lower direction, a brake in said drive train, said brake being an integral part of said drive train for transmitting power from said supply to said drum, said brake being located in an upper stage of said drive train for providing downstream drag on said drum when said brake is decoupled, means for releasing said brake to permit movement of the drive train downstream of the brake and thus lowering rotational movement of the drum, a free-spool decoupling device located in the drive train close to said drum and downstream of said brake for releasing said drum for free rotation, and manually operated control means for actuating said clutch, brake and free-spool decoupling means.

11. The winch of claim 10, said drive train including a drive shaft, said one-way clutch being on an upstream end of said shaft, said brake being on a downstream end of said shaft.

* * * * *